US011358152B2

(12) United States Patent
Gui et al.

(10) Patent No.: US 11,358,152 B2
(45) Date of Patent: Jun. 14, 2022

(54) UNDERGROUND COAL SEPARATION PROCESS ADOPTING WATER MEDIUM

(71) Applicant: CHINA UNIVERSITY OF MINING AND TECHNOLOGY, Jiangsu (CN)

(72) Inventors: Xiahui Gui, Jiangsu (CN); Min Liu, Jiangsu (CN); Yaowen Xing, Jiangsu (CN); Yangchao Xia, Jiangsu (CN); Yijun Cao, Jiangsu (CN); Jiaqian Luo, Jiangsu (CN); Peikun Liu, Shandong (CN); Zhigang Wang, Beijing (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 29 days.

(21) Appl. No.: 15/733,895

(22) PCT Filed: Apr. 22, 2019

(86) PCT No.: PCT/CN2019/083671

§ 371 (c)(1),
(2) Date: Dec. 1, 2020

(87) PCT Pub. No.: WO2020/181619

PCT Pub. Date: Sep. 17, 2020

(65) Prior Publication Data

US 2021/0094045 A1 Apr. 1, 2021

(30) Foreign Application Priority Data

Mar. 8, 2019 (CN) ..... 201910174684.X

(51) Int. Cl.
*B03B 9/00* (2006.01)
*B03B 7/00* (2006.01)

(52) U.S. Cl.
CPC ..... *B03B 9/005* (2013.01); *B03B 7/00* (2013.01)

(58) Field of Classification Search
CPC ..... B03B 9/005; B03B 7/00; B03B 5/10
See application file for complete search history.

(56) References Cited

U.S. PATENT DOCUMENTS 3,031,074 A * 4/1962 Osawa ..... B03B 5/30 209/172.5
4,173,530 A * 11/1979 Smith ..... B65G 53/30 406/197
4,529,506 A 7/1985 Smit

FOREIGN PATENT DOCUMENTS

CN 101716552 A * 6/2010
CN 101757974 A * 6/2010
(Continued)

OTHER PUBLICATIONS

"International Search Report (Form PCT/ISA/210)" of PCT/CN2019/083671, dated Sep. 4, 2019, with English translation thereof, pp. 1-4.

(Continued)

*Primary Examiner* — Latosha Hines
(74) *Attorney, Agent, or Firm* — JCIP Global Inc.

(57) ABSTRACT

Disclosed is an underground coal preparation process adopting a water medium, comprising: feeding raw coal into a special underground compact jigging machine to discharge overflow clean coal being dewatered through a φ1 mm fixed screen and screened through a φ13 mm classifying screen, and dewatering powder clean coal with a particle size less than 13 mm to obtain powder clean coal and a centrifugate; grading jigging middling coal by means of a φ13 mm classifying screen into block middling coal and powder middling coal, and dewatering the powder middling coal to obtain powder middling coal and a centrifugal liquid; and sending produced coal slime water to a water medium classifying and separation cyclone, and the obtained coarse middling coal slime and coarse clean coal slime respectively (Continued)

passing through a coarse middling and clean coal slime sieve bends, and then being dewatered.

4 Claims, 2 Drawing Sheets

(56) References Cited

FOREIGN PATENT DOCUMENTS

| | | | | |
|---|---|---|---|---|
| CN | 102773153 | | | 11/2012 |
| CN | 103143432 | | | 6/2013 |
| CN | 103816992 | A | * | 5/2014 |
| CN | 104588404 | A | * | 5/2015 |
| CN | 108745623 | | | 11/2018 |

OTHER PUBLICATIONS

"Written Opinion of the International Searching Authority (Form PCT/ISA/237)" of PCT/CN201 9/083671, dated Sep. 4, 2019, pp. 1-4.

* cited by examiner

UNDERGROUND COAL SEPARATION PROCESS ADOPTING WATER MEDIUM

CROSS-REFERENCE TO RELATED APPLICATION

This application is a 371 of international application of PCT application serial no. PCT/CN2019/083671, filed on Apr. 22, 2019, which claims the priority benefit of China application no. 201910174684.X, filed on Mar. 8, 2019. The entirety of each of the above mentioned patent applications is hereby incorporated by reference herein and made a part of this specification.

TECHNICAL FIELD

The present invention relates to a coal separation process, and in particular, to an underground coal separation process adopting a water medium, which is suitable for underground coal mine.

BACKGROUND

With the development and utilization of coal resources and the increasing mining depth, a large number of goafs are faced with the problems such as ground surface collapse, and overground coal separation brings huge pressure to the surrounding ecological environment of a coal preparation plant, so there is a very urgent demand for the underground coal separation technology At present, the coal separation method is divided into wet coal separation and dry coal separation. The wet coal separation refers to a method for performing coal separation in the water medium, such as a jigging separation method, a heavy medium cyclone separation method and the like; and the dry coal separation refers to a method for performing coal separation in the air and includes a wind coal separation, a fluidized bed coal separation method, a composite coal separation method and the like. The dry coal separation is faced with the following problems:

1. Small range of separation particle size and poor separation effect of fine materials affect the separation efficiency of dry separation.

2. The requirement on the content of water outside the raw material is high, and dust fall by spraying water in the coal mining link bring a large amount of water, so that fine coal is caked to affect the coal separation effect.

3. The separation lower limit of the dry coal separation is high and the separation effect of the fine materials is difficult to ensure, so it is necessary to filter out the fine materials and the coal separation difficulty is improved.

4. The energy consumption of the dry coal separation equipment is higher than that of the wet coal separation equipment.

Therefore, underground coal separation mostly adopts the dry method to pre-discharge gangue. Jigging separation and heavy medium separation are most commonly used in wet coal separation, the separation precision is high and the separation lower limit is low, but the wet coal separation for underground also has the following problems:

1. A large amount of coal slime water is generated in wet coal separation, and it is difficult to clarify washing water.

2. It is necessary for heavy medium separation to increase the process of preparing and recovering the heavy medium, and this part of equipment needs to occupy a large amount of space, which contradicts the limited available space underground.

In addition, in order to adapt to the complex coal feature and completely exert the optimal working effect of existing equipment, the raw coal is generally classified and selected, the pre-screening link is increased and the underground equipment dynamic load is increased, so that the separation process is more complex. A reasonable underground coal separation process should comprehensively consider the underground coal separation environment and the index requirements of coal separation products; and the underground coal separation process is required to have the characteristics of low separation particle size lower limit, high separation precision and simple coal separation process flow.

SUMMARY OF THE INVENTION

An objective of the present invention is to provide an underground coal separation process adopting a water medium, with the advantages of simple process, high reliability of separation equipment, relatively small dynamic load and high separation precision.

To achieve the above object, the present invention provides an underground coal separation process adopting a water medium, including the following steps:

directly feeding exploited raw coal into a special underground compact jigging machine without going up to a well for separation to obtain overflow clean coal, jigging middling coal and jigging gangue wherein the jigging gangue is applied to underground filling;

feeding the overflow clean coal into a φ1 mm fixed screen for predewatering to obtain oversize clean coal and undersize water discharged under the screen and containing clean coal with a particle size of less than 1 mm, feeding the undersize water into a coal slime pool, feeding the oversize clean coal into a φ13 mm classifying screen for separation to obtain block clean coal with a particle size greater than 13 mm and powder clean coal with a particle size less than 13 mm, wherein the block clean coal is discharged as a clean coal product, the powder clean coal is fed into a clean coal centrifugal dewatering machine for dewatering to obtain powder clean coal and centrifugate, the powder clean coal is discharged as a clean coal product, and the centrifugate I is fed into the coal slime pool;

feeding the jigging middling coal into a φ13 mm classifying screen by a material discharging mechanism for classification, and performing separation to obtain block middling coal with a particle size greater than 13 mm and powder middling coal with a particle size less than 13 mm, wherein the lock middling coal is discharged as a middling coal product, the powder middling coal with a particle size less than 13 mm is fed into a middling coal centrifugal dewatering machine for dewatering to obtain powder middling coal and centrifugate II, the powder middling coal is discharged as a middling coal product and the centrifugate II is fed into the coal slime pool;

mixing the undersize water containing clean coal with a particle size less than 1 mm, the centrifugate and the centrifugate II in the coal slime pool to obtain coal slime water, feeding the coal slime water into a water medium classifying and separation cyclone by a slurry pump, classifying the coal slime water at the first section of the water medium classifying and separation cyclone, enabling underflow after first-section classification to enter a second section of the cyclone for separation to obtain coarse clean coal slime of second-section overflow and coarse middling coal slime of underflow, feeding the coarse middling coal slime of underflow into a coarse middling coal slime sieve bend, feeding the coarse clean coal slime into a coarse clean coal slime sieve bend for dewatering, returning sieve bend underflow of the coarse middling coal slime sieve bend and sieve bend underflow of the coarse clean coal slime sieve bend to the coal slime pool to obtain predewatered coarse middling coal slime above the coarse middling coal slime sieve bend and obtain predewatered coarse clean coal slime above the coarse clean coal slime sieve bend, feeding the predewatered coarse middling coal slime into a coarse middling coal slime centrifugal dewatering machine for dewatering to obtain coarse middling coal slime and centrifugate III, discharging the coarse middling coal slime as a middling coal product, feeding the predewatered coarse clean coal slime into a coarse clean coal slime centrifugal dewatering machine for dewatering to obtain coarse clean coal slime and centrifugate IV, discharging the coarse clean coal slime as a clean coal product, and returning the centrifugate III and the centrifugate IV to the coal slime pool; and feeding first-section overflow into a stirring barrel, adding a sedimentation-promoting medicament into the stirring barrel through a medicament adding box and completely stirring to obtain pretreated coal slime water, feeding the pretreated coal slime water into a roadway high-efficiency concentrator for sedimentation to obtain overflow and concentrator underflow, feeding the overflow of the roadway high-efficiency concentrator into a clarifying pool to serve as circulating water, performing filter pressing and dewatering on the concentrator underflow of the roadway high-efficiency concentrator by a filter press to obtain coal slime and filter press filtrate, discharging the coal slime, and feeding the filter press filtrate into the clarifying pool.

The centrifugate I may still contain part of coarse clean coal slime after being classified and separated by the cyclone and being centrifuged and dewatered, which is unfavorable for economic benefit and subsequent coal slime water treatment, so the centrifugate I is fed into the coal slime pool; and the centrifugate II contains coarse middling coal slime and existing coarse particles will affect the work of the concentrator, so the centrifugate II is fed into the coal slime pool.

The model of the special underground compact jigging machine JYT-J series, the model of the roadway high-efficiency concentrator YT-N series, and the specific model parameters are determined according to the field process requirements.

Liquid in the clarifying pool serves as circulating water after being sedimented and separated, and the circulating water in the clarifying pool is conveyed to a circulating water inlet of the special underground compact jigging machine.

Beneficial Effects

According to the present invention, the coal separation method adopting a water medium has no requirement on the water content of the raw coal and is high in separation precision and reliability; full-particle-size selection is realized, there is no pre-screening link, dynamic load brought by underground screening equipment is reduced, and safety and comfortability of underground production are enhanced; the method does to relate to a heavy medium separation process, thus reducing medium loss, equipment investment and wear rate of pipelines and equipment and simplifying process; there is no flotation process, thus saving underground space and reducing equipment pressure, and meanwhile, a collector and a foaming agent are avoided, thus ensuring the underground production safety and being beneficial to controlling and improving the underground production environment; the separation clean coal, middling coal and coal slime are transported out as products, and the gangue is filled underground, thereby reducing transportation energy consumption and the impact of coal mining on geology and environment; the selected special underground compact jigging machine has a more optimal structure and smaller size compared with the conventional jigging machine, and the single-machine theoretical treatment capacity reaches 1000 t/h, which meets the production requirement while according with the underground space limitation; the water medium classifying and separation cyclone has classifying and separation functions, the first section is of a cylindrical flat bottom structure and provides a larger space for accurately classifying fine particles, the first-section underflow enters the second section for separation, and the second section is of a cylindrical-conical structure and may provide a powerful centrifugal force field to realize accurate separation of coal gangue; and the clean coal and middling coal are transported to the well after separation of the raw coal, and the gangue serves as the underground filling raw material, thus reducing useless energy consumption brought by gangue transportation, ground surface environmental pollution and the influence of coal mining on the underground rock stratum.

Figure 1:
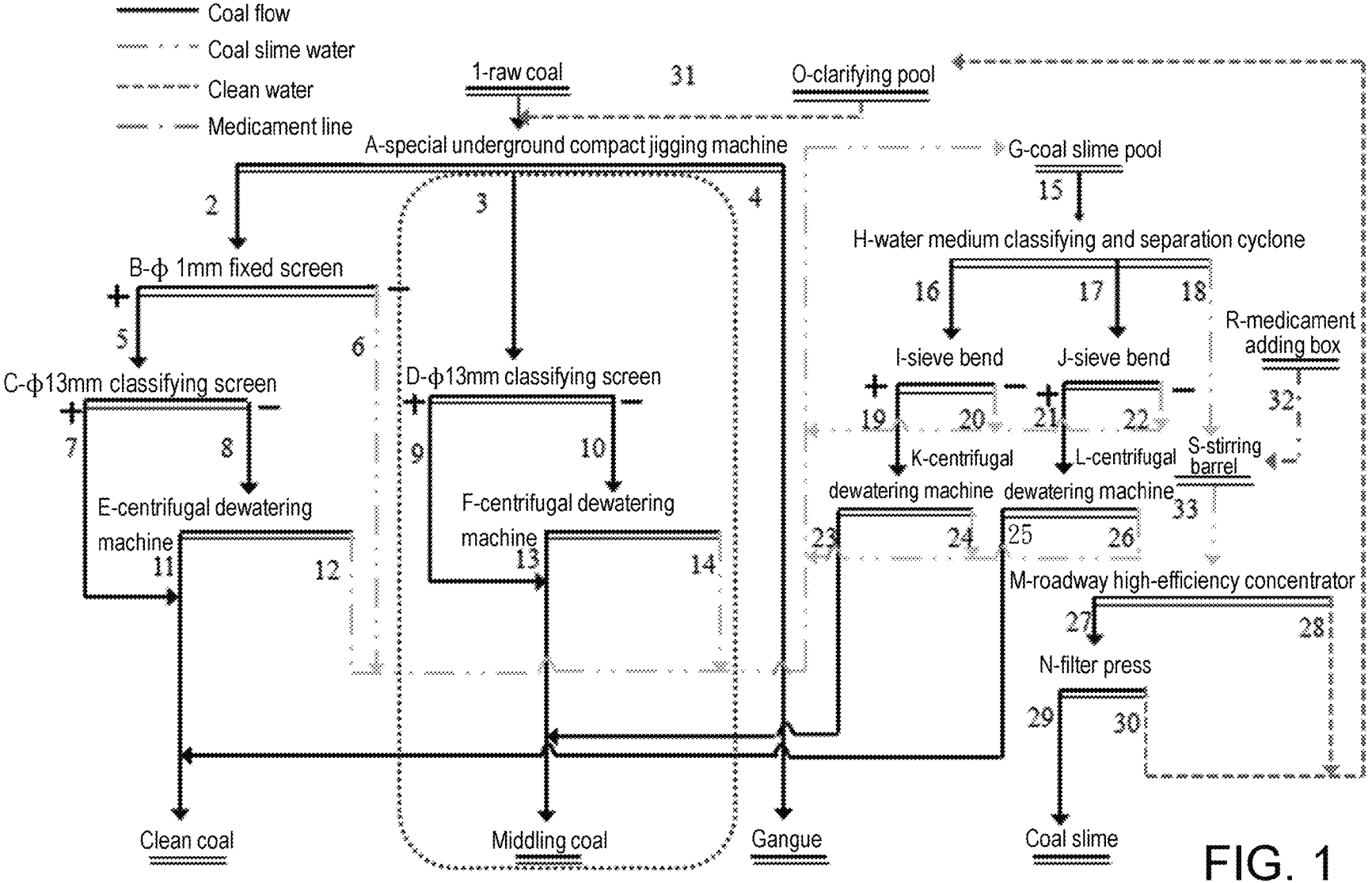
FIG. 1 is a flowchart of an underground coal separation processing adopting a water medium according to the present invention.

In the drawings: 1—raw coal, 2—overflow clean coal, 3—jigging middling coal, 4—jigging gangue, 5—oversize clean coal, 6—undersize water, 7—block clean coal, 8—powder clean coal with a particle size less than 13 mm, 9—block middling coal, 10—powder middling coal with a particle size less than 13 mm, 11—powder clean coal, 12—centrifugate I, 13—powder middling coal, 14—centrifugate II, 15—coal slime water, 16—coarse middling coal slime, 17—coarse clean coal slime of second-section overflow, 18—first-section overflow, 19—predewatered coarse middling coal slime, 20—sieve bend underflow, 21—coarse clean coal slime, 22—sieve bend underflow, 23—coarse middling coal slime, 24—centrifugate III, 25—coarse clean coal slime, 26—centrifugate IV, 27—concentrator underflow, 28—overflow, 29—coal slime, 30—filter press filtrate, 31—circulating water, 32—coal slime water treatment medicament, 33—to-be-sedimented coal slime water;

A—special underground compact jigging machine, B—clean coal fixed screen, C—clean coal classifying screen, D—middling coal classifying screen, E—clean coal centrifugal dewatering machine, F—middling coal centrifugal dewatering machine, G—coal slime pool, H—water medium classifying and separation cyclone, I—coarse middling coal slime sieve bend, J—coarse clean coal slime sieve bend, K—coarse middling coal slime centrifugal machine, L—coarse clean coal centrifugal machine, M—roadway high—efficiency concentrator, N—coal slime filter press, O—clarifying pool, P—slurry pump, Q—clean water pump, R—medicament adding box, S—stirring barrel.

DETAILED DESCRIPTION OF THE EMBODIMENTS

The specific implementations of the present invention are further described below in detail with reference to FIG. 2.

Figure 2:
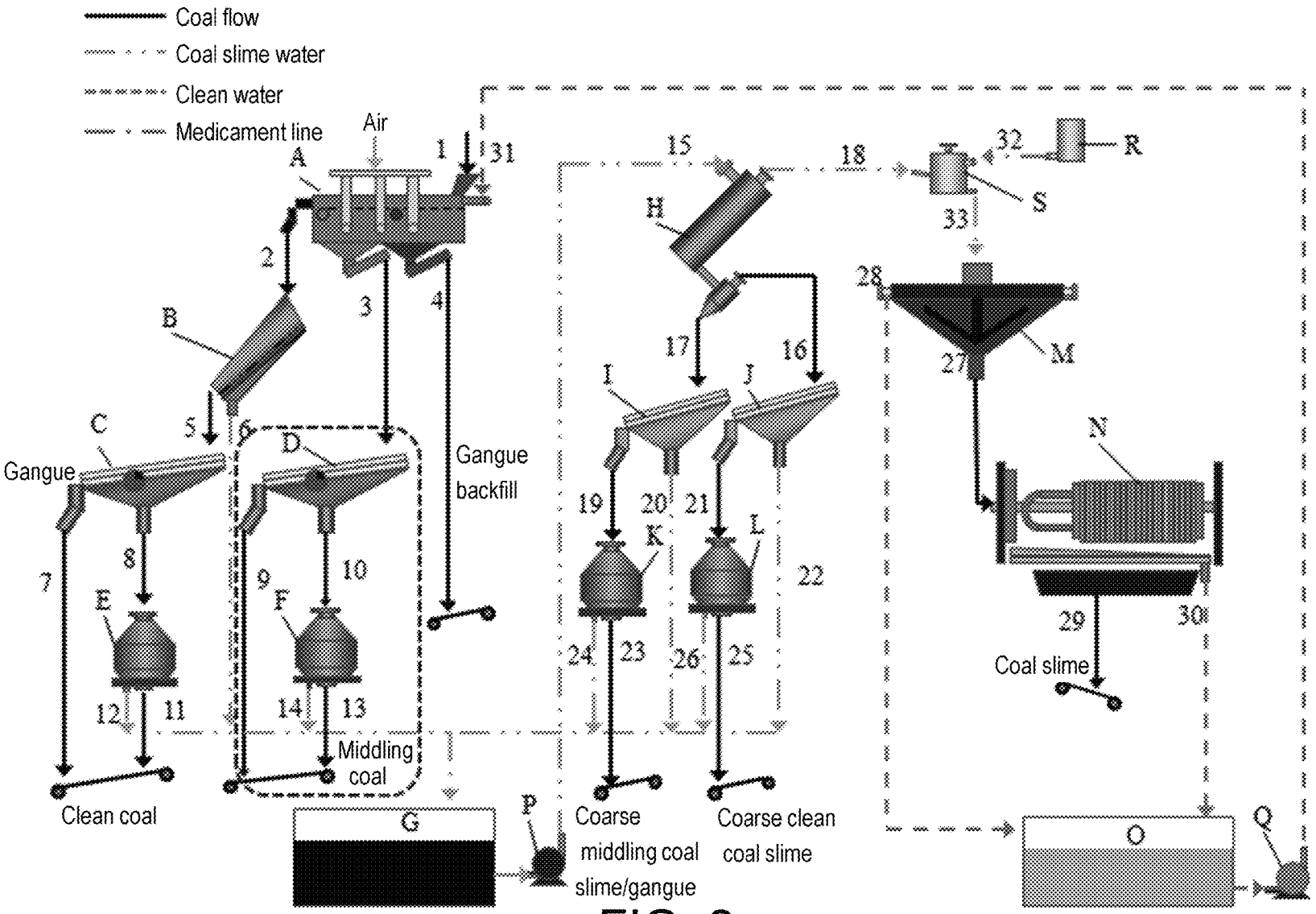
FIG. 2 is a structural diagram of equipment according to the present invention.

As shown in FIG. 1 and FIG. 2, the underground coal separation process adopting a water medium according to the present invention is characterized by including the following steps:

exploited raw coal 1 is directly fed into a special underground compact jigging machine A without going up to a well for separation to obtain overflow clean coal 2, jigging middling coal 3 and jigging gangue 4, wherein the jigging gangue 4 is applied to underground filling;

the overflow clean coal 2 is fed into a φ1 mm fixed screen B for predewatering to obtain oversize clean coal 5 and undersize water 6 discharged under the screen and containing clean coal with a particle size of less than 1 mm, the undersize water 6 is fed into a coal slime pool G, the oversize clean coal 5 is fed into a φ13 mm classifying screen C for separation to obtain block clean coal 7 with a particle size greater than 13 mm and powder clean coal 8 with a particle size less than 13 mm, wherein the block clean coal 7 is discharged as a clean coal product, the powder clean coal 8 is fed into a clean coal centrifugal dewatering machine E for dewatering to obtain powder clean coal 11 and centrifugate 12, the powder clean coal 11 is discharged as a clean coal product, and the centrifugate I 12 is fed into the coal slime pool G;

the jigging middling coal 3 is fed into a φ13 mm classifying screen D by a material discharging mechanism for classification, and separation is conducted to obtain block middling coal 9 with a particle size greater than 13 mm and powder middling coal 10 with a particle size less than 13 mm, wherein the lock middling coal 9 is discharged as a middling coal product, the powder middling coal 10 with a particle size less than 13 mm is fed into a middling coal centrifugal dewatering machine F for dewatering to obtain powder middling coal 13 and centrifugate II 14, the powder middling coal 13 is discharged as a middling coal product, and the centrifugate II 14 is fed into the coal slime pool G;

the undersize water 6 containing clean coal with a particle size less than 1 mm, the centrifugate 12 and the centrifugate II 14 in the coal slime pool G are mixed to obtain coal slime water 15, the coal slime water 15 is fed into a water medium classifying and separation cyclone H by a slurry pump P, the coal slime water 15 is classified at the first section of the water medium classifying and separation cyclone H, underflow after first-section classification enters a second section of the cyclone for separation to obtain coarse clean coal slime 17 of second-section overflow and coarse middling coal slime 16 of underflow, the coarse middling coal slime 16 of underflow is fed into a coarse middling coal slime sieve bend I, the coarse clean coal slime 17 is fed into a coarse clean coal slime sieve bend J for dewatering, sieve bend underflow 20 of the coarse middling coal slime sieve bend I and sieve bend underflow 22 of the coarse clean coal slime sieve bend J return to the coal slime pool G to obtain predewatered coarse middling coal slime 19 above the coarse middling coal slime sieve bend I and obtain predewatered coarse clean coal slime 21 above the coarse clean coal slime sieve bend J, the predewatered coarse middling coal slime 19 is into a coarse middling coal slime centrifugal dewatering machine K for dewatering to obtain coarse middling coal slime 23 and centrifugate III 24, the coarse middling coal slime 23 is discharged as a middling coal product, the predewatered coarse clean coal slime 21 is fed into a coarse clean coal slime centrifugal dewatering machine L for dewatering to obtain coarse clean coal slime 25 and centrifugate IV 26, the coarse clean coal slime 25 is discharged as a clean coal product, and the centrifugate III 24 and the centrifugate IV 26 return to the coal slime pool G; and first-section overflow 18 is fed into a stirring barrel S, a sedimentation-promoting medicament 32 is added into the stirring barrel S through a medicament adding box R and stirring is conducted completely to obtain pretreated coal slime water 33, the pretreated coal slime water 33 is fed into a roadway high-efficiency concentrator M for sedimentation to obtain overflow 28 and concentrator underflow 27, the overflow 28 of the roadway high-efficiency concentrator M is fed into a clarifying pool O to serve as circulating water, the concentrator underflow 27 of the roadway high-efficiency concentrator M is subjected to filter pressing and dewatering by a filter press N to obtain coal slime 29 and filter press filtrate 30, the coal slime 29 is discharged, and the filter press filtrate 30 is fed into the clarifying pool O.

The centrifugate I 12 may still contain part of coarse clean coal slime after being classified and separated by the cyclone and being centrifuged and dewatered, which is unfavorable for economic benefit and subsequent coal slime water treatment, so the centrifugate I 12 is fed into the coal slime pool; and the centrifugate II 14 contains coarse middling coal slime and existing coarse particles will affect the work of the concentrator, so the centrifugate II 14 is fed into the coal slime pool G.

The model of the special underground compact jigging machine A JYT-J series, the model of the roadway high-efficiency concentrator M YT-N series, and the specific model parameters are determined according to the field process requirements.

What is claimed is:

1. An underground coal separation process adopting a water medium, comprising the following steps:

directly feeding an exploited raw coal into a special underground compact jigging machine without going up to a well for separation to obtain an overflow clean coal, a jigging middling coal and a jigging gangue, wherein the jigging gangue is applied to underground filling;

feeding the overflow clean coal into a φ1 mm fixed screen for predewatering to obtain an oversize clean coal and an undersize water discharged under the screen and containing a clean coal with a particle size less than 1 mm, feeding the undersize water into a coal slime pool, feeding the oversize clean coal into a first φ13 mm classifying screen for separation to obtain a block clean coal with a particle size greater than 13 mm and a first powder clean coal with a particle size less than 13 mm, wherein the block clean coal is discharged as a clean coal product, the first powder clean coal is fed into a clean coal centrifugal dewatering machine for dewatering to obtain a second powder clean coal and a first centrifugate, the second powder clean coal is discharged as a clean coal product, and the first centrifugate is fed into the coal slime pool;

feeding the jigging middling coal into a second φ13 mm classifying screen by a discharging mechanism for classification, and separating to obtain a block middling coal with a particle size greater than 13 mm and a first powder middling coal with a particle size less than 13 mm, wherein the block middling coal is discharged as a middling coal product, the first powder middling coal with a particle size less than 13 mm is fed into a middling coal centrifugal dewatering machine for dewatering to obtain a second powder middling coal and a second centrifugate, the second powder middling coal is discharged as a middling coal product, and the second centrifugate is fed into the coal slime pool;

mixing the undersize water containing a clean coal with a particle size less than 1 mm, the first centrifugate and the second centrifugate in the coal slime pool to obtain a coal slime water, feeding the coal slime water into a water medium classifying and separation cyclone by a slurry pump, classifying the coal slime water at the first section of the water medium classifying and separation cyclone, enabling an underflow after first-section classification to enter a second section of the cyclone for separation to obtain a first coarse clean coal slime of a second-section overflow and a first coarse middling coal slime of the underflow, feeding the first coarse middling coal slime of the underflow into a coarse middling coal slime sieve bend, feeding the first coarse clean coal slime into a coarse clean coal slime sieve bend for dewatering, returning a sieve bend underflow of the coarse middling coal slime sieve bend and a sieve bend underflow of the coarse clean coal slime sieve bend to the coal slime pool to obtain a predewatered coarse middling coal slime above the coarse middling coal slime sieve bend and obtain predewatered coarse clean coal slime above the coarse clean coal slime sieve bend, feeding the predewatered coarse middling coal slime into a coarse middling coal slime centrifugal dewatering machine for dewatering to obtain a second coarse middling coal slime and a third centrifugate, discharging the second coarse middling coal slime as a middling coal product, feeding the predewatered coarse clean coal slime into a coarse clean coal slime centrifugal dewatering machine for dewatering to obtain a second coarse clean coal slime and a fourth centrifugate, discharging the second coarse clean coal slime as a clean coal product, and returning the third centrifugate and the fourth centrifugate to the coal slime pool; and feeding first-section overflow into a stirring barrel, adding a sedimentation-promoting medicament into the stirring barrel through a medicament adding box and completely stirring to obtain a pretreated coal slime water, feeding the pretreated coal slime water into a roadway high-efficiency concentrator for sedimentation to obtain an overflow and a concentrator underflow, feeding the overflow of the roadway high-efficiency concentrator into a clarifying pool to serve as a circulating water, performing filter pressing and dewatering on the concentrator underflow of the roadway high-efficiency concentrator by a filter press to obtain a coal slime and a filter press filtrate, discharging the coal slime, and feeding the filter press filtrate into the clarifying pool.

2. The underground coal separation process adopting a water medium according to claim 1, wherein the first centrifugate may still contain part of coarse clean coal slimes after being classified and separated by the cyclone and being centrifuged and dewatered, so the first centrifugate is fed into the coal slime pool; and the second centrifugate contains coarse middling coal slimes and existing coarse particles will affect the work of the concentrator, so the second centrifugate is fed into the coal slime pool.

3. The underground coal separation process adopting a water medium according to claim 1, wherein a model of the special underground compact jigging machine is JYT-J series, a model of the roadway high-efficiency concentrator is YT-N series, and specific model parameters are determined according to requirements of an on-site process.

4. The underground coal separation process adopting a water medium according to claim 1, wherein a liquid in the clarifying pool serves as a circulating water after being sedimented and separated, and the circulating water in the clarifying pool is conveyed to a circulating water inlet of the special underground compact jigging machine.

* * * * *